US005401280A

United States Patent [19]

Kaneko et al.

[11] Patent Number: 5,401,280

[45] Date of Patent: * Mar. 28, 1995

[54] LEAD-FREE, HIGH-OCTANE GASOLINE

[75] Inventors: Takashi Kaneko; Jun Akimoto; Tatsuo Omata, all of Yokohama, Japan

[73] Assignee: Nippon Oil Co., Ltd., Tokyo, Japan

[ * ] Notice: The portion of the term of this patent subsequent to Oct. 26, 2010 has been disclaimed.

[21] Appl. No.: 136,793

[22] Filed: Oct. 14, 1993

[30] Foreign Application Priority Data

Oct. 14, 1992 [JP] Japan ..... 4-301855

[51] Int. Cl.[6] ..... C10L 1/18

[52] U.S. Cl. ..... 44/449; 44/459

[58] Field of Search ..... 44/449, 459

[56] References Cited

U.S. PATENT DOCUMENTS

| | | | |
|---|---|---|---|
| 2,952,612 | 9/1960 | Trainer | 44/449 |
| 3,224,848 | 12/1965 | Henderson | 44/449 |
| 4,468,233 | 8/1984 | Bruderreck et al. | 44/449 |
| 4,519,809 | 5/1985 | Hochhauser | 44/449 |
| 5,141,525 | 8/1992 | Stüwe et al. | 44/449 |
| 5,256,167 | 10/1993 | Kaneko et al. | 44/459 |

FOREIGN PATENT DOCUMENTS 9108999 7/1991 WIPO .

OTHER PUBLICATIONS

European Search Report of Jan. 20, 1994 regarding European Patent Application EP 93 30 8099.

*Primary Examiner*—Jacqueline V. Howard

*Attorney, Agent, or Firm*—Panitch Schwarze Jacobs & Nadel

[57] ABSTRACT

Lead-free, high-octane gasolines are made up of a selected class of $C_5$-paraffinic and $C_6$-hydrocarbons and a methyl-t-butylether compound (MTBE) such that they have specified physical properties of research octane numbers, Reid vapor pressures, densities at 15° C. and sulfur contents and also have blended specified amounts of the MTBE compound and of those hydrocarbons to satisfy the requirements as determined by several specified equations. Startability of a cold automobile engine is conspicuously improved and emission of NOx reduced.

7 Claims, No Drawings

LEAD-FREE, HIGH-OCTANE GASOLINE

BACKGROUND OF THE INVENTION

1. Technical Field

This invention relates to lead-free, high-octane gasolines for use in motor vehicles and more particularly to such a gasoline having unique compositional and physical characteristics.

2. Prior Art

It is known that among various qualities of motor gasoline, the vapor pressure is important to ensure efficient operation of automobile engines. This pressure if at too low a level renders the engine less startable at low temperature and if at too high a level leads to marred driveability at elevated temperature. To cope with this sort of dilemma, the volatility parameter is necessarily adjusted to match those climatic conditions in which the gasoline is used. As concerns Japan's seasonal changes of climate, such parameter is desired to be lower in summer season from May through September and conversely higher in winter season from October through April.

In 1983 a lead-free, high-octane gasoline came into the market which had a research octane number of 98, and in 1987 another commercial grade made its debut with a similar number of 100. Due to their freedom from blending of a methyl-t-butylether compound (MTBE) which appears hereunder in detail, both grades rely solely upon their respective hydrocarbon components in gaining the above octane ratings and hence have a large proportion of aromatic hydrocarbons. As disclosed for instance in U.S. Pat. No. 4,824,552, a further grade has been proposed which is formulated to have certain distillation and composition properties, thereby improving acceleration and other important fuel qualities.

MTBE is commonly accepted for use as a component in gasolines of high octane requirements. In the United States automobile industry, such compound is reputed for contributing to reduced amounts of carbon monoxides and hydrocarbon components escaping as undesirable exhaust emissions. MTBE-blended, high-octane gasolines are disclosed in Japanese Patent Publications Nos. 50-35524 and 60-11958. In 1991 this type of gasoline was marketed in Japan.

Though large in octane number, MTBE is relatively low-boiling and light-natured. This means that blending of MTBE will produce a gasoline of a light nature even with a high octane requirement. While satisfactory startability of a cold engine can be expected with use of light gasoline, MTBE blending is reported susceptible to poor engine startup. Another but serious problem is that MTBE tends to increase nitrogen oxides (NOx) in exhaust gas.

SUMMARY OF THE INVENTION

Through research efforts made to eliminate the foregoing drawbacks of the prior art, it has now been found that lead-free, high-octane gasolines of enhanced benefits for automotive use can be obtained by the use of a selected class of hydrocarbons combined with MTBE. The hydrocarbons here are chosen from those of 5 and 6 carbon atoms, respectively, and blended in specified contents in the gasoline.

The present invention seeks to provide an improved gasoline of a lead-free, high-octane type which enables an automotive engine to readily acceleratively start up even at low temperature and at the same time reduce NOx emission to an absolute minimum during driving of the vehicle.

The above and related objects and features of the invention will be better understood from the following description.

More specifically, the invention provides a lead-free, high-octane gasoline comprising a $C_5$-hydrocarbon, a $C_6$-hydrocarbon and a methyl-t-butylether compound (MTBE) and having a research octane number of not less than 98.0, a Reid vapor pressure of 0.40 to 0.95 kgf/cm$^2$, a density of 0.735 to 0.755 g/cm$^3$ at 15° C. and a sulfur content of not more than 50 ppm by weight, the gasoline meeting with the requirements of equations (1) to (5):

$$3 \leqq V(M) \leqq 15 \quad (1)$$

$$(a)\ 17 \leqq V(C_5) \leqq 20 \text{ in the case of } 0.40 \leqq Rv < 0.65 \quad (2)$$

$$(b)\ 18 \leqq V(C_5) \leqq 25 \text{ in the case of } 0.65 \leqq Rv \leqq 0.70 \text{ and}$$

$$(c)\ 20 \leqq V(C_5) \leqq 35 \text{ in the case of } 0.70 < Rv \leqq 0.95;$$

$$15 \leqq V(C_6) \leqq 30 \quad (3)$$

$$0.55 \leqq V(C_{5p})/V(C_5) \leqq 0.90; \text{ and}$$

$$11.5 + 0.1 \times V(M) \leqq V(C_{5p}) \quad (5)$$

where V(M) is the amount of the MTBE compound, Rv is the Reid vapor pressure, $V(C_5)$ is the amount of the $C_5$-hydrocarbon, $V(C_6)$ is the amount of the $C_6$-hydrocarbon, and $V(C_{5p})$ is the $C_5$-paraffinic hydrocarbon, each of the amounts being expressed by % by volume and based on the total gasoline.

DETAILED DESCRIPTION OF THE INVENTION

Lead-free, high-octane gasolines contemplated under the present invention essentially comprise a selected class of hydrocarbons described later and an MTBE compound. The term lead-free gasoline used refers to a gasoline product made without addition of a lead alkylate such as tetraethyl lead. Either one of these alkylate compounds even if somehow entrained in the gasoline must not exceed the lower bounds stipulated as acceptable by the procedure of JIS K-2255.

Advantageously, the gasoline of the invention has a set of specific physical characteristics including research octane numbers, Reid vapor pressures, densities at 15° C. and sulfur contents.

Research octane numbers useful in the invention are not less than 98.0, preferably greater than 99.5, more preferably above 100.0. Measurement is made according to JIS K-2280.

Suitable Reid vapor pressures are in the range of 0.40 to 0.95, preferably 0.55 to 0.95, more preferably 0.55 to 0.85, all these numerical figures being expressed by kgf/cm$^2$ as determined by JIS K-2258. This pressure if smaller than 0.40 kgf/cm$^2$ would impair engine startability at low temperature and if greater than 0.95 kgf/cm$^2$ would lead to objectionable vapor lock at high temperature and hence insufficient driving performance.

The vapor pressure needs to be varied, as stated above, with ambient temperatures around actual service of the gasoline. So long as the gasoline of the invention is applied in Japan, that pressure for summer use is in the range of 0.40 to 0.70, preferably 0.55 to 0.70, more preferably 0.55 to 0.68, most preferably 0.55 to 0.65, and for winter use in the range of 0.65 to 0.95, preferably 0.68 to 0.95, more preferably 0.70 to 0.95, most preferably 0.70 to 0.85, each such numerical figure being by kgf/cm$^2$.

Eligible densities at 15° C. range from 0.735 to 0.755, preferably 0.740 to 0.755, more preferably 0.742 to 0.755, still more preferably 0.745 to 0.755, most preferably 0.745 to 0.750, all these numerical figures being expressed by g/cm$^3$ as determined by JIS K-2249. Below 0.735 g/cm$^3$ would not be economical with a rise of fuel consumption, and above 0.755 g/cm$^3$ would cause inadequate acceleration and/or spark plug fouling.

Sulfur contents used here are not more than 50, preferably smaller than 30, more preferably below 20, as measured by JIS K-2541 and expressed by ppm by weight. This content if larger than 50 ppm by weight would be responsible for malfunction of an exhaust gas cleaner built in a car used.

The gasoline according to the invention is made up essentially of specific hydrocarbons and an MTBE compound. One such is chosen from those of 5 carbon atoms, referred to as "a $C_5$-hydrocarbon", and another hydrocarbon is chosen from those of 6 carbon atoms, referred to as "a $C_6$-hydrocarbon". Contained in the first mentioned hydrocarbon are paraffinic and non-paraffinic hydrocarbons, where the former is referred to herein as "a $C_5$-paraffinic hydrocarbon.

Importantly, the gasoline of the invention should be designed to have the following compositional characteristics set forth by equations (1) to (5).

$$3 \leqq V(M) \leqq 15 \quad (1)$$

$$(a)\ 17 \leqq V(C5) \leqq 20 \text{ in the case of } 0.40 \leqq Rv \leqq 0.65$$

$$(b)\ 18 \leqq V(C5) \leqq 25 \text{ in the case of } 0.65 \leqq Rv \leqq 0.70$$

$$(c)\ 20 \leqq V(C5) \leqq 35 \text{ in the case of } 0.70 \leqq Rv \leqq 0.95$$

$$15 \leqq V(C_6) \leqq 30 \quad (3)$$

$$0.55 \leqq V(C_{5p})/V(C_5) \leqq 0.90 \quad (4)$$

$$11.5 + 0.1 \times V(M) \leqq V(C_{5p}) \quad (5)$$

In the above equations, V(M) is the amount of MTBE (% by volume), Rv is the Reid vapor pressure (kgf/cm$^2$), V($C_5$) is the amount of the $C_5$-hydrocarbon ( % by volume ), V($C_6$ is the amount of the $C_6$-hydrocarbon (% by volume), and V($C_{5p}$) is the amount of the $C_5$-paraffinic hydrocarbon (% by volume). Each of V(M), V($C_5$), V($C_6$) and V($C_{5p}$) is based on the total gasoline.

Details of equations (1) to (5) are explained below, all hydrocarbon amounts are taken as being based on the total gasoline.

As defined by V(M) (% by volume) in equation (1), MTBE is added in the range of 3 to 15, preferably 3 to 10, more preferably 4 to 7, most preferably 4 to 6. Below 3% by volume would produce no appreciable results, whereas above 15% by volume would increase fuel consumption and moreover show a sharp rise in NOx emission. MTBE is derived usually by reaction of isobutylene with methanol, but the invention is not limited to that mode of reaction.

The amount of the $C_5$-hydrocarbon, V($C_5$)(% by volume) in equations (2)(a) to (2)(c), varies with the magnitude of the Reid vapor pressure, Rv(kgf/cm$^2$). When Rv is in the range of $0.40 \leqq Rv \leqq 0.65$ in equation (2)(a), V($C_5$) is in the range of $17 \leqq V(C_5) \leqq 20$, preferably $18 \leqq V(C_5) \leqq 20$. When Rv is $0.65 \leqq Rv < 0.70$ in equation (2)(b), V($C_5$) is $18 \leqq V(C_5) \leqq 25$, preferably $20 \leqq V(C_5) \leqq 25$, more preferably $22 \leqq V(C_5) \leqq 25$. When Rv is $0.70 \leqq Rv \leqq 0.95$ in equation (2)(c), V($C_5$) is $20 \leqq V(C_5) \leqq 35$, preferably $22 \leqq V(C_5) \leqq 35$, more preferably $24 \leqq V(C_5) \leqq 30$. Departures of V($C_5$) from the lower bounds in the three cases would not be effective to improve startability of a cold engine and further to reduce emission of NOx. Failure to satisfy the upper bounds would suffer from objectionable vapor lock which in turn makes the vehicle insufficiently driveable.

The amount of the $C_6$-hydrocarbon, V($C_6$)(% by volume) in equation (3), is in the range of $15 \leqq V(C_6) \leqq 30$, preferably $16 \leqq V(C_6) \leqq 30$, more preferably $17 \leqq V(C_6) \leqq 30$. Below 15% by volume would fail to attain improved engine startability and reduced NOx emission. Above 30% by volume would adversely affect fuel saving.

The amount of the $C_5$-paraffinic hydrocarbon is determined in ratio to the amount of the first or $C_5$-hydrocarbon as defined by V($C_{5p}$)(% by volume)/V($C_5$)(% by volume) in equation (4). The ratio is in the range of $0.55 \leqq V(C_5) \leqq 0.90$, preferably $0.59 \leqq V(C_{5p})/V(C_5) \leqq 0.86$, more preferably $0.61 \leqq V(C_{5p})/V(C_5) \leqq 0.86$, most preferably $0.61 \leqq V(C_{5p})/V(C_5) \leqq 0.80$. Below 0.55 would be ineffective in reducing NOx emission, while above 0.90 would pose a decline in octane number.

The amount of the third hydrocarbon, V($C_{5p}$)(% by volume), is also associated closely with the amount of MTBE, V(M)(% by volume), as set forth in equation (5). The quantitative relationship between V($C_{5p}$) and V(M) is $11.5 + 0.1 \times V(M) \leqq V(C_{5p})$ , preferably $12.0 + 0.1 \times V(M) \leqq V(C_{5p})$, more preferably $12.5 + 0.1 \times V(M) \leqq V(C_{5p})$. If V($C_{5p}$) were less than $11.5 + 0.1 \times V(M)$, then NOx could not be reduced as required.

The contents of V($C_5$), V($C_6$) and V($C_{5p}$) in the gasoline of the invention are as determined by gas chromatography. Analysis is made with the use of a methyl silicone-made capillary column, a helium or nitrogen carrier gas and an FID detector under a set of conditions of 25 to 50 mm in column length, 0.5 to 1.5 ml/min in gas flow rate, 1:50 to 1:250 in partition ratio, 150° to 250° C. in inlet temperature, −10° to 10° C. in initial column temperature, 200° to 250° C. in end column temperature and 150° to 250° C. in detector temperature.

Specific examples of the $C_5$-hydrocarbon include n-pentane, isopentane, neopentane, 1-pentene, 2-pentene, 2-methyl-1-butene, 3-methyl-1-butene, 2-methyl-2-butene, cyclopentene and the like. Specific examples of the $C_6$-hydrocarbon include n-hexane, 2-methylpentane, 3-methylpentane, 2,2-dimethylbutane, 2,3-dimethylbutane, 1-hexene, 2-hexene, 3-hexene, 2-methyl-1-pentene, 3-methyl-1-pentene, 4-methyl-1-pentene, 2-methyl-2-pentene, 3-methyl-2-pentene, 4-methyl-2-pentene, 2,3-dimethyl-2-butene, cyclohexane, methylcyclopentane, cyclohexene, 1-methylcyclopentene, 3-methylcyclopentene, 4-methylcyclopentene, benzene and the like. The $C_5$-paraffinic hydrocarbon is chosen from n-pentane, isopentane and neopentane and the like.

Though not restricted, the distillation properties of the hydrocarbons employed in the invention may be selected where desired. For example, when equation (2)(a) or $0.40 \leqq Rv \leqq 0.65$ is applied, a 30% distillation temperature is set at from 60° to 70° C. a 50% distillation temperature at from 85° to 95° C. a 70% distillation temperature is higher than 113° C. and a 90% distillation temperature at lower than 160° C. When equation (2)(b) or $0.65 \leqq Rv \leqq 0.70$ is applied, similar temperatures are set in the order mentioned at from 57° to 67° C. 80° to 93° C., higher than 108° C. and lower than 155° C. When equation (2)(c) or $0.70 < Rv \leqq 0.95$ is applied, similar temperatures are likewise set at 55° to 65° C., 77° to 90° C. higher than 105° C. and lower than 150° C. The distillation temperatures of 30%, 50%, 70% and 90% are those measured by JIS K-2254.

The compositions of the hydrocarbons according to the invention are optional which however are convenient in the case where an olefins content is below 18% by volume and an aromatics content below 42% by volume. Both contents are determinable by JIS K-2536.

No particular restriction is imposed upon the production method for the gasoline of the invention. MTBE may be blended usually with any suitable known base gasolines, examples of which are chosen from cracked gasoline derivable by catalytic cracking or hydrocracking, reformed gasoline obtainable by catalytic reforming, polymerized gasoline available by olefin polymerization, alkylates derivable by addition reaction or alkylation of a hydrocarbon such as isobutane with a lower olefin, light naphtha, isomerized gasoline, de-n-paraffinized oil, butane, and oil fractions and aromatic hydrocarbons thereof with a given range of boiling points.

To be more specific, the $C_5$-non-paraffinic and $C_6$-hydrocarbons according to the invention may be available by blending of light fractions of light naphtha and reformed gasoline, light fractions of cracked gasoline, and isomerized gasoline. The $C_5$-paraffinic hydrocarbon may be obtained mainly from light naphtha, light fractions of reformed gasoline and from isomerized gasoline.

The gasoline of the invention is made feasible by blending conventional base gasolines in optional ratios on condition that MTBE should be incorporated in the above specified range of amounts. One typical formulation resides in blending MTBE (3 to 15%) with light naphtha (0 to 10%), a light fraction resulting from reformed gasoline and boiling at from its initial point to about 120° C. (5 to 35%), a heavy fraction generating from reformed gasoline and boiling at from about 110° C. to its end point (15 to 45%), a light fraction originating from cracked gasoline and boiling at from its initial point to about 90° C. (15 to 45%), an alkylate (0 to 25%) and butane (0 to 10%). All these percentages are by volume.

It is to be noted, however, that enhanced startability of a cold engine and reduced emission of NOx can be achieved only by strict observance of the specified physical characteristics, coupled with the specified compositional characteristics of equations (1) to (5). To this end, base gasolines to be used should be selectively varied with their respective properties and compositions. Without resort to these determinants, the MTBE-base gasoline blend exemplified above does not provide a gasoline intended to be obtained by the invention.

Various other additives may be employed which include antioxidants such as Schiff type compounds and thioamide compounds, surface ignition inhibitors such as organic phosphorus compounds, detergent dispersants such as imide succinates, polyalkylamines and polyetheramines, antiicing agents such as polyalcohols and their ethers, combustion improvers such as organic acid-derived alkali metal salts and alkaline earth metal salts, antistatic agents such as anionic, cationic and ampholytic surfactants and colorants such as azo dyes. They may be used singly or in combination and are added preferably in an amount of not more than 0.1 part by weight per 100 parts by weight of the gasoline.

Further, octane number improvers may be added when desired. They include alcohols such as methanol, ethanol, isopropanol and t-butanol and ethers such as ethyl-t-butylether, methyl-t-amylether and ethyl-t-amylether either alone or in combination. The amount of this additive is preferably less than 10 parts by volume per 100 parts by volume of the gasoline.

EXAMPLES

The present invention will now be described by way of the following examples which should be regarded as illustrative.

For the sake of brevity, several inventive examples and several comparative examples are here labeled as "IE" and "CE", respectively. All percentages are indicated by volume in these examples unless otherwise noted.

Details of those base gasolines used in the examples are listed in Table 1.

IE-1 and CE-1

MTBE (5%) was blended with light naphtha (4%), fraction A (15%), fraction C (38%), fraction D (26%) and alkylate (12%), thereby obtaining an inventive gasoline. To facilitate comparison, MTBE was added in a similar or 5% amount and other parameters varied, whereupon a comparative gasoline was obtained. The compositions of the test gasolines are listed in Table 2.

Performance evaluation was made under the conditions set below and with the results shown also in Table 2.

Gas Exhaustion Test

An emission of NOx (g/km) was determined by a 10-mode testing procedure of exhaust gas on a passenger car installed with a 2.2-liter displacement, fuel injection-type. engine, an automatic transmission, a three-way catalyst and an oxygen sensor.

Engine Acceleration Test at Low Temperature

Testing carried out with use of a passenger car assembled with a 1.8-liter displacement, feul injection-type engine, a manual transmission, a three-way catalyst and an oxygen sensor. In a chamber kept at 0° C. and on a chassis dynamo, the engine was allowed to start at cold ambient temperature and then accerelate at three different full speeds of 30 to 70 km/hr. The time for acceleration was measured which was required from startup to maximum speed. Averaged ware the results made available from three to five repetition tests.

As evidenced by the tabulated data, the inventive gasoline has been found satisfactory in respect of both qualities tested. Because of its departures in $V(C_5)$, $V(C_6)$ and $V(C_{5p})$ from the scopes of the invention, the comparative gasoline led to increased NOx emission and prolonged engine acceleration.

IE-2 and CE-2

An inventive gasoline was produced by blending MTBE (5%) with fraction A (11%), fraction B (10%), fraction C (33%), fraction D (31%) and alkylate (10%). A comparative gasoline was prepared to contain MTBE at a similar level and base gasolines in amounts outside the ranges specified by the invention. The compositions of the test gasolines are listed in Table 3.

Targeted qualities were checked as in IE-1 with the results shown also in Table 3.

air-to-fuel ratio thus obtained was taken as a measure of engine startup at low temperature.

CE-3 was unacceptable in the two tested qualities due to its too small a content in $V(C_5)$. In CE-4 of too low a $V(C_{5p})/V(C_5)$, a sharp increase in NOx emission was observed even with an acceptable level of air-to-fuel response.

TABLE 1

| base gasoline | light naptha | fraction A | fraction B | fraction C | fraction D | alkylate | butane |
|---|---|---|---|---|---|---|---|
| research octane number | 74.1 | 93.0 | 84.1 | 114.0 | 96.2 | 96.5 | 92.0 |
| $V(C_5)$ vol % | 43.1 | 16.7 | 34.6 | 0.0 | 57.3 | 6.7 | 0.0 |
| $V(C_6)$ vol % | 41.1 | 33.9 | 40.2 | 0.0 | 31.5 | 6.1 | 0.0 |
| $V(C_{5p})$ vol % | 39.0 | 16.2 | 33.7 | 0.0 | 31.4 | 6.4 | 0.0 |
| olefin content vol % | 0 | 2 | 3 | 0 | 47 | 1 | 0 |
| aromatic content vol % | 0 | 40 | 17 | 92 | 1 | 0 | 0 |

fraction A: light fraction of reformed gasoline bp: initial point −120° C.
fraction B: light fraction of reformed gasoline bp: initial point −105° C.
fraction C: heavy fraction of reformed gasoline bp: 105° C. - end poit
fraction D: light fraction of cracked gasoline bp: initial point −90° C.

Gas Exhaustion Test

The car and procedure for IE-1 were followed except that the displacement was changed at a 2.0-liter level and the transmission to a manual type.

Engine Acceleration Test at Low Temperature

The car and procedure for IE-1 were followed except that the displacement was changed at a 2.0-liter level.

IE-2 demonstrates that the $V(C_5)$, $V(C_6)$, $V(C_{5p})$ and $V(C_{5p})/V(C_5)$ parameters are important to attain reduced Nox emission and improved engine startability. Both qualities were proved unacceptable in the case of CE-2 in which all those parameters were set to fall outside the scope of the invention.

IE-3 and CE-3 and CE-4

To produce an inventive gasoline, MTBE (5%) was blended with light naphtha (3%), fraction B (15%), fraction C (35%), fraction D (30%), alkylate (10%) and butane (2%). Two different comparative gasolines were prepared with MTBE added at a similar level and with other parameters varied in amounts outside the specified ranges. The compositions of these gasolines are listed in Table 4.

Gas Exhaustion Test

A maximum concentration of NOx in exhaust gas was measured on a 2.0-liter displacement, fuel injection-type engine with a three-way catalyst and an oxygen sensor. With the catalyst maintained at 350° C. and with the engine operated at 800 rpm, gas exhaustion was carried out at varying intake manifold pressures of −550 to −440 mmHg.

Air-to-Fuel Response Test

A 3.0-liter displacement, fuel injection-type engine was used. Mounted on the fuel injection device was a signal indicator regulated to change an air-to-fuel ratio from 18 to 12 under conditions with 40° C. in engine lubricant oil temperature, 1,200 rpm in engine revolution and −400 mmHg in intake manifold pressure. Varied ratios of air to fuel in a gas mixture in the cylinder at ten cycles of strokes were determined from which were calculated any variations of the air-to-fuel ratio in the cylinder relative to the amount of fuel injected. The

TABLE 2

| gasoline/quality | IE-1 | CE-1 |
|---|---|---|
| research octane number | 100.2 | 101.4 |
| Reid vapor pressure (Rv) kgf/cm$^2$ | 0.64 | 0.60 |
| density 15° C. g/cm$^3$ | 0.749 | 0.754 |
| sulfur content ppm | 3 | 3 |
| V(M) vol % | 5 | 5 |
| $V(C_5)$ vol % | 19.9 | 15.5 |
| $V(C_6)$ vol % | 15.6 | 13.2 |
| $V(C_{5p})$ vol % | 12.9 | 9.2 |
| $V(C_{5p})/V(C_5)$ | 0.65 | 0.59 |
| $11.5 + 0.1 \times V(M)$ vol % | 12.0 | 12.0 |
| 30% distillation temp °C. | 68 | 70 |
| 50% distillation temp °C. | 91 | 97 |
| 70% distillation temp °C. | 117 | 126 |
| 90% distillation temp °C. | 142 | 146 |
| olefin content vol % | 13 | 15 |
| aromatic content vol % | 41 | 43 |
| NOx concentration g/km | 0.029 | 0.035 |
| acceleration time sec. | 9.30 | 9.45 |

TABLE 3

| gasoline/quality | IE-2 | CE-2 |
|---|---|---|
| research octane number | 100.4 | 101.3 |
| Reid vapor pressure (Rv) kgf/cm$^2$ | 0.68 | 0.65 |
| density 15° C. g/cm$^3$ | 0.748 | 0.752 |
| sulfur content ppm | 2 | 3 |
| V(M) vol % | 5 | 5 |
| $V(C_5)$ vol % | 23.7 | 17.7 |
| $V(C_6)$ vol % | 18.1 | 14.3 |
| $V(C_{5p})$ vol % | 15.5 | 9.6 |
| $V(C_{5p})/V(C_5)$ | 0.65 | 0.54 |
| $11.5 + 0.1 \times V(M)$ vol % | 12.0 | 12.0 |
| 30% distillation temp °C. | 65 | 67 |
| 50% distillation temp °C. | 87 | 93 |
| 70% distillation temp °C. | 116 | 124 |
| 90% distillation temp °C. | 142 | 142 |
| olefin content vol % | 15 | 16 |
| aromatic content vol % | 37 | 42 |
| NOx concentration g/km | 0.070 | 0.085 |
| accelerarion time sec. | 5.73 | 5.81 |

TABLE 4

| gasoline/quality | IE-3 | CE-3 | CE-4 |
|---|---|---|---|
| research octane number | 100.3 | 101.1 | 100.4 |
| Reid vapor pressure (Rv) kgf/cm$^2$ | 0.72 | 0.70 | 0.72 |
| density 15° C. g/cm$^3$ | 0.746 | 0.749 | 0.743 |
| sulfur content ppm | 4 | 4 | 4 |
| V(M) vol % | 5 | 5 | 5 |
| $V(C_5)$ vol % | 24.3 | 19.6 | 28.7 |
| $V(C_6)$ vol % | 17.3 | 16.8 | 16.0 |
| $V(C_{5p})$ vol % | 16.3 | 11.6 | 12.2 |

TABLE 4-continued

| gasoline/quality | IE-3 | CE-3 | CE-4 |
|---|---|---|---|
| $V(C_{5p})/V(C_5)$ | 0.67 | 0.59 | 0.43 |
| 11.5 + 0.1 × V(M) vol % | 12.0 | 12.0 | 12.0 |
| 30% distillation temp °C. | 63 | 67 | 60 |
| 50% distillation temp °C. | 85 | 91 | 80 |
| 70% distillation temp °C. | 114 | 116 | 118 |
| 90% distillation temp °C. | 141 | 143 | 141 |
| olefin content vol % | 16 | 16 | 25 |
| aromatic content vol % | 35 | 41 | 35 |
| NOx concentration g/km | 610 | 930 | 800 |
| air-to-fuel response % | 78 | 75 | 78 |

What is claimed is:

1. A lead-free, high-octane gasoline comprising a $C_5$-hydrocarbon, a $C_6$-hydrocarbon and a methyl-t-butylether compound (MTBE) and having a research octane number of not less than 98.0, a Reid vapor pressure of 0.40 to 0.95 kgf/cm$^2$, a density of 0.735 to 0.755 g/cm$^3$ at 15° C. and a sulfur content of not more than 50 ppm by weight, the gasoline meeting with the requirements of equations (1) to (5);

$$3 \leqq V(M) \leqq 15 \quad (1)$$

$$(a)\ 17 \leqq V(C_5) \leqq 20 \text{ in the case of } 0.40 \leqq Rv < 0.65 \quad (2)$$

$$(b)\ 18 \leqq (C_5) \leqq 25 \text{ in the case of } 0.65 \leqq Rv \leqq 0.70 \text{ and}$$

$$(c)\ 20 \leqq V(C_5) \leqq 35 \text{ in the case of } 0.70 \leqq Rv \leqq 0.95$$

$$15 \leqq V(C_6) \leqq 30 \quad (3)$$

$$0.55 \leqq V(C_{5p})/V(C_5) \leqq 0.90; \text{ and} \quad (4)$$

$$11.5 + 0.1 \times V(M) \leqq V(C_{5p}) \quad (5)$$

where V(M) is the amount of the MTBE compound, Rv is the Reid vapor pressure, $V(C_5)$ is the amount of the $C_5$-hydrocarbon, $V(C_6)$ is the amount of the $C_6$-hydrocarbon, and $V(C_{5p})$ is the amount of the $C_5$-paraffinic hydrocarbon, each of the amounts being expressed by % by volume and based on the total gasoline.

2. The gasoline of claim 1 wherein the $C_5$-hydrocarbon is selected from the group consisting of n-pentane, isopentane, neopentane, 1-pentene, 2-pentene, 2-methyl-1-butene, 3-methyl-1-butene, 2-methyl-2-butene and cyclopentane.

3. The gasoline of claim 1 wherein the $C_6$-hydrocarbon is selected from the group consisting of n-hexane, 2-methylpentane, 3-methylpentane, 2,2-dimethylbutane, 2,3-dimethylbutane, 1-hexene, 2-hexene, 3-hexene, 2-methyl-1-pentene, 3-methyl-1-pentene, 4-methyl-1-pentene, 2-methyl-2-pentene, 3-methyl-2-pentene, 3,3-dimethyl-1-butene, 2,3-dimethyl-2-butene, cyclohexane, methylcyclopentane, cyclohexene, 1-methylcyclopentene, 3-methylcyclopentene, 4-methylcyclopentene and benzene.

4. The gasoline of claim 1 wherein the $C_5$-paraffinic hydrocarbon is selected from the group consisting of n-pentane, isopentane and neopentane.

5. The gasoline of claim 1 wherein the $C_5$-hydrocarbon is a blend of light naphtha, a light fraction of reformed gasoline, a light fraction of cracked gasoline and isomerized gasoline.

6. The gasoline of claim 1 wherein the $C_6$-hydrocarbon is a blend of light naphtha, a light fraction of cracked gasoline and isomerized gasoline.

7. The gasoline of claim 1 wherein the $C_5$-paraffinic hydrocarbon is derived from light naphtha, a light fraction of reformed gasoline and isomerized gasoline.

* * * * *